United States Patent [19]

Grove

[11] 3,937,340

[45] Feb. 10, 1976

[54] AERIAL PLATFORM HAVING BOOM MOUNTED PIPE HOLDER

[75] Inventor: John L. Grove, Greencastle, Pa.

[73] Assignee: Fulton Industries, Inc., McConnellsburg, Pa.

[22] Filed: June 14, 1974

[21] Appl. No.: 479,438

[52] U.S. Cl. ..... 214/147 G; 182/2; 214/3

[51] Int. Cl.[2] ..... B66F 11/04

[58] Field of Search..... 214/620, 3, 83.1, 147 R, 214/147 G; 182/2, 129; 212/55–58 R

[56] References Cited

UNITED STATES PATENTS

| | | | |
|---|---|---|---|
| 2,073,998 | 3/1937 | Raby | 182/2 X |
| 3,263,834 | 8/1966 | La Tendresse | 214/147 G X |
| 3,286,855 | 11/1966 | Bill | 214/3 |
| 3,545,633 | 12/1970 | Lunoberg | 214/147 G |
| 3,809,180 | 8/1974 | Grove | 182/129 X |
| 3,819,063 | 6/1974 | Reimbold, Jr. | 214/3 |

*Primary Examiner*—Frank E. Werner
*Attorney, Agent, or Firm*—Irvin A. Lavine

[57] ABSTRACT

An aerial platform apparatus includes a vehicle, an extensible boom mounted on the vehicle for luffing and swinging movement, and a workman's platform carried by the boom. The boom at its outer end carries a support column, which supports a workman's platform and a pin holder. The pipe holder includes a horizontal oscillatable shaft located rearwardly of the platform, and including a pair of forwardly extending arms, each on one side of the platform. The arms are provided at their outer ends, which are generally forwardly of the platform, with material engaging devices, specifically releasable pipe clamps. Preferably, the arms are extensible. A motor controlled by the occupant of the platform oscillates the pipe holder shaft, and other similarly controlled motors actuate the pipe clamps and extend and retract the arms.

21 Claims, 4 Drawing Figures

AERIAL PLATFORM HAVING BOOM MOUNTED PIPE HOLDER

BACKGROUND OF THE INVENTION

The present invention relates to aerial lift platforms, in combination with apparatus for holding and moving material in position to be worked on by a workman on the platform.

Cranes, in particular vehicle-mounted cranes, have been widely used for handling material, specifically for the lifting of relatively heavy loads of material from one place, and depositing it in position at another place, the lifting and depositing being at locations which are often spaced both horizontally and vertically. When the material has been in place, it is then worked on as necessary by workmen, as by securing it in position, assembling the material or load to some other material or to a structure, or the like.

Aerial lift platforms have been widely used, these being somewhat similar to the above noted vehicle-mounted cranes, and including a vehicle with a boom mounted thereon for both horizontal swinging and vertical luffing movement, the boom carrying at or near its outer end a platform for the workman. Typically, the platform includes a floor and an upstanding protective enclosure or railing, to prevent falling of the workman from the platform. The aerial lift platform apparatus heretofore known has primarily been used for positioning a workman at an elevated location, to enable the workman to perform such tasks as repair, replacement and maintenance of equipment and structures. However, there have been several proposals for providing an aerial lift platform apparatus with material engaging, handling and/or supporting devices, so that material could be both moved and supported, with the workman on the platform in position to perform some function in connection with the material being thus supported.

In Grove U.S. Pat. No. 3,809,180, entitled Aerial Platform Apparatus Having Pipe Grabs, there is disclosed an aerial platform apparatus as above described, the workman's platform being equipped at its forward vertical face with pipe grabs, for engaging and holding a length of pipe. The platform is rotated about a horizontal axis, so that its floor is substantially vertical, thereby placing the pipe grabs at ground level. This occurs with the workman standing near the aerial platform apparatus, and controlling its movements by a remote control device. After the pipe grabs engage a pipe, the aerial platform apparatus is moved, so that the platform floor is horizontal, after which the workman mounts the platform and then raises the platform into position, so as to enable the pipe held by the pipe grabs to be installed, as near the ceiling of a building.

The aerial platform apparatus, as set forth in the above referenced patent, has been successfully used in connection with the installation of overhead sprinkler pipes. However, it is now known that in connection with this apparatus, the requirement that the workman be on the ground while the pipe is being engaged by the pipe grabs may be improved upon, as well as the necessity for supporting the weight of the pipe grabs and the pipe directly from the platform.

In P. R. Bill U.S. Pat. No. 3,286,855, there is disclosed a crane mounted on a vehicle, and provided with a boom extension comprising a beam which supports a workman's platform or bucket, and which also supports a pole guiding and gripping device, the boom extension beam being joined by a hinge to the outer end of the crane boom. At its upper end, the boom extension is provided with a load sheave, so that a cable trained over the load sheave may be secured to a pole, the pole then being hoisted to a substantially vertical position with the gripper encircling it, the workman in the bucket carred on the boom extension then being in position to guide the lifting of the pole and subsequently to perform work in relation to the pole. The construction cannot pick up a pole by the pole guide and gripper, due to the geometry of the crane boom, and the pole cannot be positioned horizontally.

SUMMARY OF THE INVENTION

An aerial platform apparatus is provided, including a wheeled vehicle having an extensible boom mounted on it for both vertical luffing and horizontal swinging movement, the boom carrying at its outer end a workman's platform. At the outer end of the boom there is provided a support column, pivotally connected to rotate about a horizontal axis, a levelling cylinder being provided so as to maintain the floor of the platform level when the boom is luffing. The support column carries horizontal bearings, located above the floor of the platform, and a horizontal shaft is carried in the bearings, extending transversely and to the rear of the platform. The horizontal shaft is provided with a pair of forwardly extending arms, one at either side of the platform. A hydraulic motor is provided for oscillating the shaft, so as to raise and lower the forwardly extending arms, the hydraulic motor being controlled from the platform. The shaft and arms, together with material engaging devices carried at outer end of the arms, constitute a pipe holder, since the material engaging devices are specifically releasable pipe clamps. The clamps are formed of two arcuate elements pivotally connected together, and a motor is connected to one of the elements to cause it to pivot, the two motors for the two releasable pipe clamps being controlled from the platform. In addition, the outer ends of the forwardly extending arms are telescopic, and a suitable hydraulic motor provided on each arm causes the ends of the arms, holding the pipe clamps, to extend or retract, in order to thereby vary the length of the arms, for adjustment purposes, the control of the arm length being from the platform. A workman on the platform can cause the shaft to be rotated so as to position the pipe clamps adjacent, actually somewhat below the platform floor, so as to pick up a pipe, and then after closing the clamps, the shaft may be rotated so as to raise or elevate the pipe into a position near the upper margin of the railing which forms a part of the platform and extends upwardly from the platform floor. The pipe will thereby be held in a working position, generally at the level of the shoulders of a workman on the platform.

An object of the present invention is the provision of an aerial platform apparatus having material holding means supported for movement relative to the platform between a lower loading position and an upper working position.

Another object of the present invention is to provide an aerial platform apparatus having material holding means which can be manipulated independently of the platform, so as to move bodily relative thereto between a lower loading position and an upper working position.

Yet another object of the present invention is the provision of an aerial platform apparatus in which material holding means are provided which are supported from the boom independently of the platform.

A still further object of the present invention is to provide an aerial platform apparatus in which the weight of the material holding means and the material held thereby are not borne by the workman's platform.

A still further object of the present invention is the provision of an aerial platform apparatus which is capable of picking up material, such as pipe, and supporting the material, all without requiring the platform floor to be in a vertical or near-vertical position, and also without requiring the workman to be dismounted from the apparatus while the material engagement and pick-up is being effected.

DESCRIPTION OF THE PREFERRED EMBODIMENTS

Figure 1:
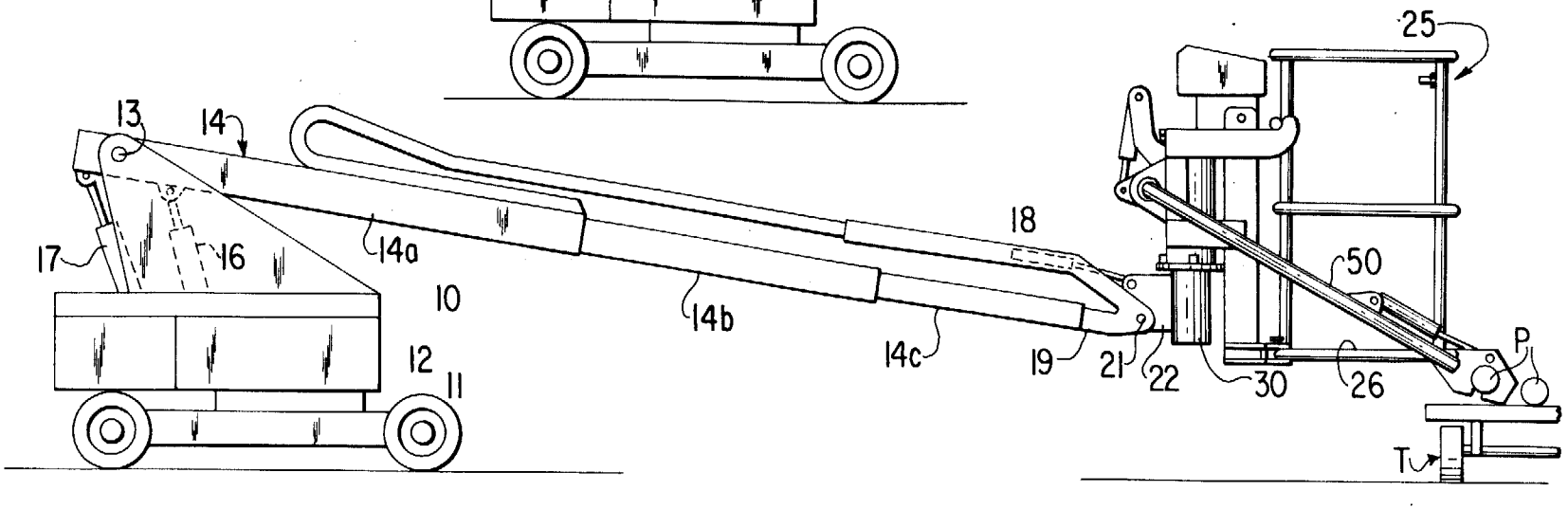
FIG. 1 is an elevational view of an aerial platform apparatus in accordance with the present invention, while engaging a pipe.

Referring now to the drawings, wherein like or corresponding reference numerals are used to designate like or corresponding parts throughout the several views, there is shown in FIG. 1 an aerial platform apparatus 10 in accordance with the present invention, including a wheeled, self-propelled chassis 11 having a rotatable boom support structure 12 mounted thereon. Support structure 12 may be rotated about a vertical axis, and has a horizontal pivot 13 which carries the inner end of an extensible, multi-section boom 14. Boom 14 includes a base section 14*a*, a mid-section 14*b* and a fly section 14*c*, and also includes apparatus, not shown, for extending and retracting the sections 14*b* and 14*c*. A hydraulic motor 16, known as a lifting cylinder, is carried by the structure 12, and engages the boom 14, so as to cause luffing movement of boom 14 about the pivotal axis 13. A hydraulic motor 17 of the linearly extensible type is connected to the structure 12 and to the rear of boom 14, so as to be actuated upon luffing movement of boom 14. This is a master cylinder of a self-levelling system, the self-levelling system also including a slave cylinder 18 which is carried adjacent the outer end of the fly section 14*c*. Slave cylinder 18 is connected to master cylinder 17 so that as boom 14 is luffed, a workman's platform 25 is rotated on a horizontal pivot, to maintain the floor 26 thereof in horizontal position.

The slave cylinder 18 is supported by U-shaped support 19 which is secured to the outer end of the fly section 14*c*. Support 19 carries a horizontal pivot 21, which supports a plate 22 and a support column 30. The platform 25 is carried by the support column 30, and the support column 30 also carries a pipe holder, generally designated 50. The pipe holder 50 is shown in a lower position where it may be seen engaging one pipe P of a plurality of such pipes, supported on a suitable support structure, in this case the support structure being illustrated as a truck T. Although not shown, a workman will be in position in the workman's platform 25, controlling the entire aerial platform apparatus 10, including the pipe holder 50.

Figure 2:
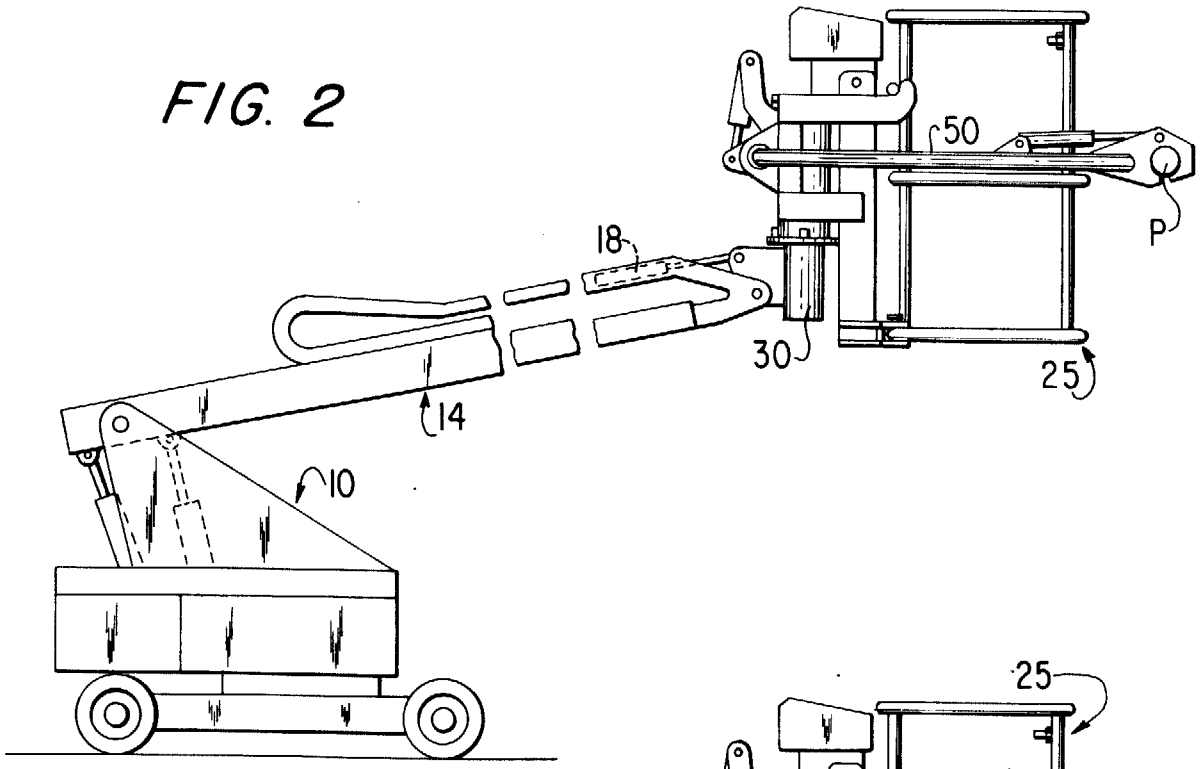
FIG. 2 is a view similar to FIG. 1, with the platform elevated and the pipe being moved to working position.

Referring now to FIG. 2, the aerial platform apparatus 10 is shown with the pipe holder 50 holding the pipe P, in an intermediate position between a lower pipe engaging position and an upper working position. Also, the boom 14 will be seen to have been luffed upwardly so that the aerial platform apparatus 10 is shown in FIG. 2 being moved so as to elevate the workman and the pipe towards the working position of the platform 25 and towards the working position of the pipe holder 50.

Figure 3:
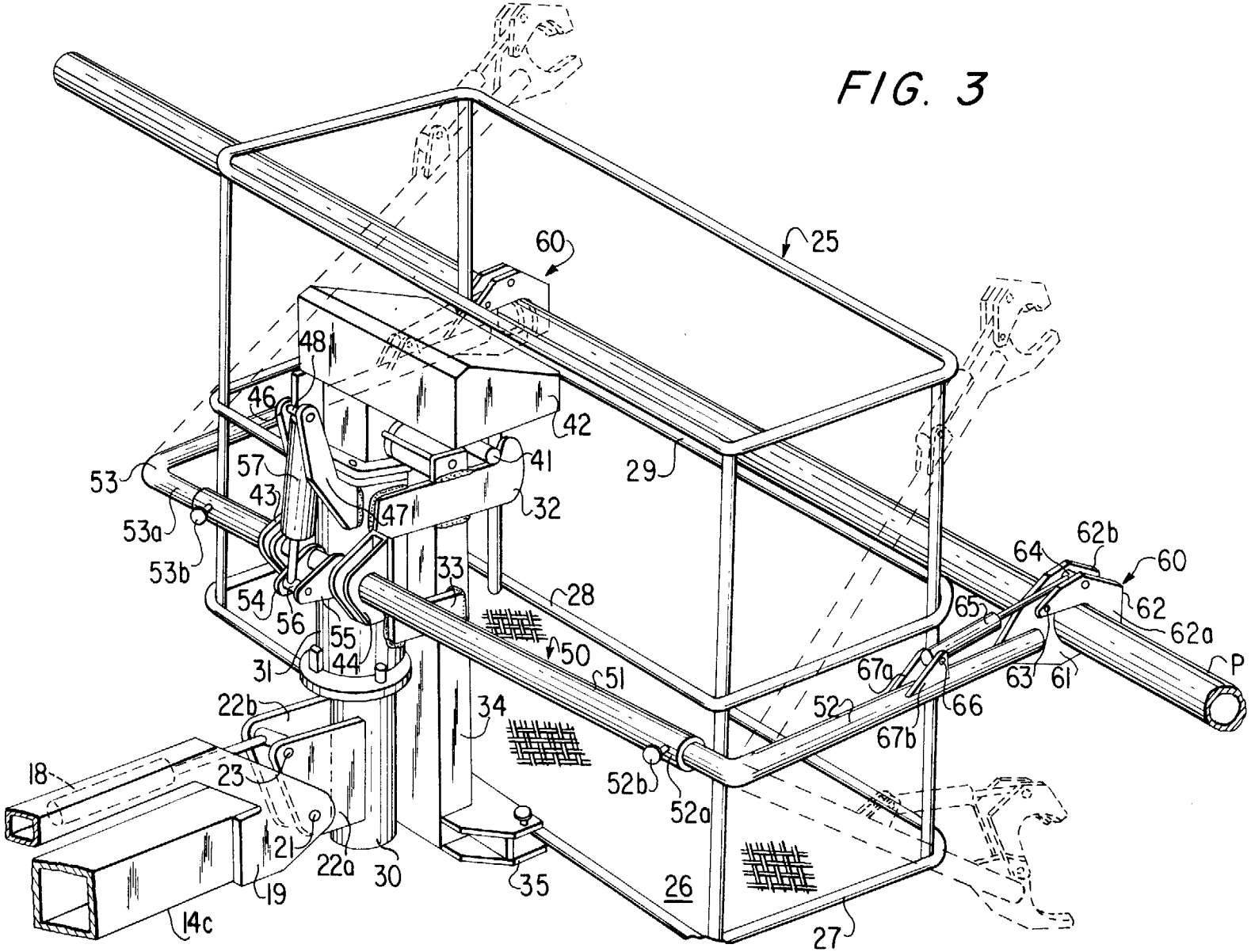
FIG. 3 is a perspective view, taken from the rear, showing the outer end of the boom, workman's platform and pipe holder.

Referring now to FIG. 3, there may be seen the end portion of the fly section 14*c*, the support 19 and the pivot 21: the plate 22 may be seen to comprise a pair of spaced parallel support plates 22*a* and 22*b*, provided with a second pivot 23 between them, to which is connected the piston rod of the slave cylinder 18.

The support plate 22 is joined to the support column 30, as by welding, support column 30 including a rotatable sleeve 31. The sleeve 31 may be rotated on its axis by a motor within the support column 30, in order to thereby rotate the workman's platform 25 and the pipe holder 50 on the axis of support column 30. In this way, the rear portion of the workman's platform 25 may be caused to assume a position adjacent either side of the boom 14.

The sleeve 31 has secured to it a pair of forwardly extending hooks 32, only one of which is shown in FIG. 3, and a pair of forwardly extending bars 33. Secured to the hook 32 and bar 33 is a downwardly extending carrier 34 having at its lower end a platform engaging structure 35. The platform 25 is made up of a floor 26, a peripherally extending lower rail 27, a peripherally extending intermediate rail 28 and a peripherally extending upper rail 29. The structure 35 receives the lower rail 27, and the hooks 32 receive a bar 41, also forming a part of the platform 25. Thus, the platform 25 is supported by engagement of the bar 41 with the hook 32 and the rail 27 with the structure 35. At its upper end, the support column 30 carries a control box 42, shown in the closed position. In the control box 42 there are located the controls, such as switches, which control the operation of the aerial platform apparatus 10 and the various motors and valves forming a part thereof.

The pipe holder 50 is supported from the column 30. The sleeve 31 is provided with a pair of spaced bearing blocks 43 and 44, secured to the sleeve 31, and providing a horizontal axis. The bearing blocks 43 and 44 contain anti-friction bearings (not shown). Also secured to the sleeve 31 are a pair of spaced lugs 46 and 47, with a horizontal pivot 48 extending between them.

The pipe holder 50 comprises a hollow, cylindrical shaft 51 journalled in the bearings carried in the bearing blocks 43 and 44. Thus, the shaft 51 extends transversely, in a horizontal plane when the parts are in the position shown in FIG. 3, and receives in either end thereof an end 52*a* and 53*a* of an L-shaped arm 52, 53. A securing device, such as the screws 52*b* and 53*b*, is provided for securing the arms 52 and 53 in the shaft 51. The width between the forwardly extending arms 52 and 53 may thereby be varied, due to their telescopic connection with the shaft 51, so as to permit the utilization of workman platforms 25 of different widths. Thus, in some instances, it may be desirable to provide workman's platforms of differing widths, for differing jobs or tasks, and is only necessary to substitute one platform for another, with the noted connections between the arms 52 and 53 and the shaft 51 accommodating the change in platform size. The arms 52 and 53 extend forwardly from the shaft 51, along the sides of the upstanding railing of the workman's platform 25.

The shaft 51 is provided with a pair of outstanding ears 54 and 55 secured to it, adjacent its mid-point, and pivot 56 extends between them, to which is connected the piston rod of a hydraulic motor 57, which is also pivotally connected to the pivot 48. As will be understood, suitable controls are provided in the control box 42 to control the actuation of hydraulic motor 57, and to thereby effect movement of the arms 52 and 53, as illustrated by the dotted line positions thereof.

At their outer ends, the arms 52 and 53 carry material engaging devices 60 of substantially identical construction. These devices 60 are, specifically, releasable pipe clamps including a lower jaw 61 of arcuate interior configuration, to which is pivoted an upper jaw 62, specifically made of a pair of plates 62*a* and 62*b*, pivotally connected at 63 to the lower jaw 61. A pivot 64 extends between the plates 62*a* and 62*b*, and has connected to it the piston rod of a hydraulic motor 65, which is pivotally secured by a pin 66 to ears 67*a* and 67*b* which are secured to the arm 52. The motor 65 carried on the arm 52 and the clamp device 60 are substantially identical to a motor and clamp device carried on the arm 53. These motors for the clamps 60 are controlled by suitable control means carried in control box 42, such as switches controlling valves in the hydraulic circuit extending between the motors and a suitable pump.

Figure 4:
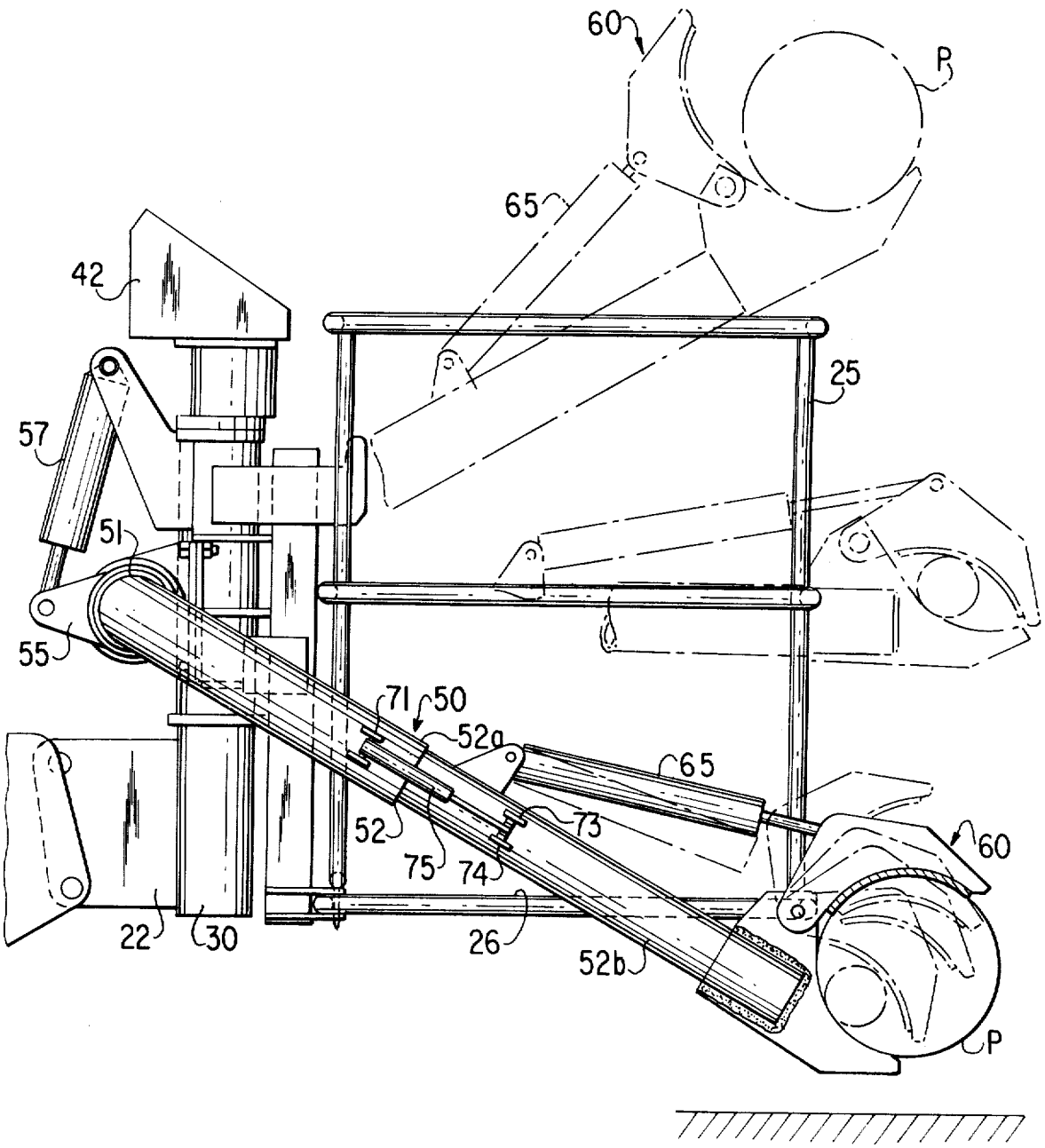
FIG. 4 is a side elevation showing a modification of the pipe holder.

Referring now to FIG. 4, there may be seen the workman's platform 25 and the support column 30, together with the control box 42 and motor 57 for the shaft 51. The arm 52 in this embodiment is extensible and comprises a rear portion 52*a* and a forward portion 52*b*. The pipe clamp 60, as in the embodiment of FIGS. 1–3, is carried on the outer end of the arm 52, and is provided with a motor 65. A pair of ears 71 and 72 are secured to the rear portion 52*a* and a pair of ears 73 and 73 are secured to the forward portion 52*b*. A motor 75 is carried by a pivot extending between the ears 71 and 72, with its piston rod pivotally connected to a pivot extending between the ears 73 and 74. Due to the telescopic construction of the arm 52, and the motor 75 and its connections, the length of arm 52 may be varied, by extending and retracting, as desired, the arm portion 52*b*. This adjustment of the length of the arm 52, as well as of the arm 53, is controlled by suitable control devices carried in control box 42.

As is clearly shown in FIGS. 1 and 4, the material engaging devices 60 may be moved to a lower position near, or even below, the floor 26 of platform 25, in order to pick up material, such as a pipe P. The pipe clamp motors 65 may then be energized so as to clamp the pipe, and thereby hold it during further movement, including elevation thereof. The construction of the pipe clamp 60 is such that, as illustrated in FIG. 4, pipes of different sizes may be firmly grasped by the pipe clamps 60. By actuating the motor 57, the shaft 51 is rotated so as to elevate the pipe clamps 60 and the pipe held thereby, into the upper position shown in FIG. 4. Thereupon, the motors 65 may be energized so as to open the pipe clamps 60, and the pipe P, having been secured in position, is released and the platform 25 and clamps 60 are removed from the vicinity of the pipe P.

In some instances, the aerial platform apparatus 10 may be positioned with its longitudinal axis generally parallel to the axis of the pipe P when it is in its intended position, adjacent the ceiling of a building or room. In that case, after picking up a pipe as illustrated in FIG. 1, and luffing the boom upwardly as illustrated in FIG. 2, while, if desired, rotating the pipe holder 50, the entire platform 25 may be rotated about the axis of support column 30, so as to position the rear of the platform 25, which is that portion closest to the support column 30, in position adjacent one side or the other of the boom 14. In some instances, it is desirable that the axis of the pipe P, while held by the pipe holder 50, be at some inclination to the horizontal. This can be accomplished by actuating the motor 18, which will thereby move the support column 30 so that its axis is inclined to the vertical, with the result that the axis of the pipe P will be inclined to the horizontal. Also, in connection with the embodiment of FIG. 4, extension of one or the other of the arms 52 and 53 may be effected, to accomplish the same purpose.

The platform 25 is boarded or mounted by the workman, who controls the movement of the vehicle, the movement of the boom and the movement of the pipe holder from the control box 42 and the control elements therein. Consequently, the workman while on or in the platform 25 is in position to view the operation of picking up material, such as pipe, and to control all necessary movements during the pick up operation. Due to his position in the platform, he has an extremely advantageous view of the relative position of the pipe clamps 60 and the pipe which is to be picked up. In addition, utilization of the aerial platform apparatus 10 as herein disclosed is more efficient since the workman may mount the platform, move the aerial platform apparatus 10 into position, pick up the pipe, and then elevate the platform and the pipe holder 50 so as to place the pipe in working or operating position rapidly. The working position or operating position may be adjusted to suit conditions, including the height of the workman. For instance, in a preferred task to be performed by the herein disclosed apparatus, which is the lifting and assemblage of sprinkler pipes adjacent the ceiling of a building, it is desirable to have the pipe in a working position approximately at the level of chest or shoulders of the workman. This is the approximate position of the pipe holder 50 shown in the upper positions thereof in FIGS. 3 and 4.

There has been provided aerial lift platform apparatus with a pipe holder type material engaging means supported for movement between a lower loading position, near the floor of the platform and an upper working position, generally at shoulder level of a workman on the platform. Manipulation of the pipe holder of the present invention is effected independently of the platform, the pipe clamps being moved bodily between the lower loading position and the upper working position. The load or weight of the pipe holder and the pipe held by it are borne only by the boom, specifically the support column, thereby avoiding the imposition of loads on the platform itself. Further, there has been provided an aerial lift platform apparatus with material engaging means, in the form of pipe clamps, capable of effecting the picking up of material, such as pipe, while the workman is mounted or standing in or on the platform, and not requiring the material loading function to be performed with the workman not occupying the platform.

It will be obvious to those skilled in the art that various changes may be made without departing from the spirit of the invention, and therefore the invention is not limited to what is shown in the drawings and described in the specification but only as indicated in the appended claims.

I claim:

1. Aerial platform apparatus comprising:
a vehicle and a boom mounted on said vehicle for luffing moment in a vertical plane,
means for luffing said boom,
a platform, means connecting said platform to the outer end of said boom for pivotal movement about a horizontal axis,
material engaging means,
means movably supported from said boom independent of said platform for movably supporting said material engaging means and for placing said material engaging means in a first position below or adjacent said platform floor and a second position substantially above said platform floor providing access by a workman on said platform to material engaged by said engaging means and means for selectively moving said material engaging means supporting means to said positions.

2. The aerial platform apparatus of claim 1, said material engaging means supporting means comprising means for positioning said material engaging means forwardly of said platform.

3. The aerial platform apparatus of claim 1, wherein said boom comprises a support member at the free end thereof, and said material engaging means supporting means comprises means connecting said material engaging means to said support member.

4. The aerial platform apparatus of claim 3, said means connecting said material engaging means to said support member comprising a transversely extending member, and means for supporting said transversely extending member on said support member.

5. The aerial platform apparatus of claim 4, said transversely extending member being a shaft, and said means for supporting said transversely extending shaft comprising bearing means.

6. The aerial platform apparatus of claim 5, said means for moving said supporting means comprising means for rotating said shaft.

7. The aerial platform apparatus of claim 4, wherein said means connecting said material engaging means to said support member further comprises a pair of spaced forwardly extending arms connected to said transverse member, and each said arm having a material engaging member at the outer end thereof.

8. The aerial platform apparatus of claim 7, each said material engaging member comprising a clamp, and means for actuating each said clamp.

9. The aerial platform apparatus of claim 7, each said arm comprising means for varying the length thereof.

10. The aerial platform apparatus of claim 9, said arms comprising telescopic elements and said last mentioned means comprising extensible motor means connected to said telescopic elements.

11. The aerial platform apparatus of claim 9, each said material engaging member comprising a clamp, and means for actuating said clamp.

12. The aerial platform apparatus of claim 7, said transversely extending member being a shaft, and said means for supporting said transversely extending shaft comprising bearing means.

13. The aerial platform apparatus of claim 12, said means for moving said supporting means comprising means for rotating said shaft.

14. The aerial platform apparatus of claim 7, said arms being laterally of said platform.

15. Aerial platform apparatus comprising:
a base and a boom mounted on said base for luffing movement in a vertical plane,
means for luffing said boom,
a platform comprising a floor and having the rear portion thereof adjacent the outer end of said boom,
means for connecting said platform to said boom for pivotal movement about a horizontal axis,
material holding means, and
means carried from said boom for supporting said material holding means and for selectively moving said material holding means between a first material pick up position below or adjacent the platform floor and a second working position remote from the platform floor and in which second position a workman on said platform has access to material held by said material holding means.

16. The aerial platform apparatus of claim 15, said last mentioned means comprising rotatable means.

17. The aerial platform apparatus of claim 16, and means carried by said boom independent of said platform for journalling said last mentioned means.

18. The aerial platform apparatus of claim 15, said last mentioned means comprising a horizontal shaft journalled on said boom rearwardly of said platform, and a pair of forwardly extending arms carried by said shaft located at either side of said platform.

19. The aerial platform apparatus of claim 18, wherein the axis of said transverse shaft is located above the floor of said platform.

20. The aerial platform apparatus of claim 18, said arms being extensible.

21. The aerial platform apparatus of claim 18, said material holding means comprising releasable clamp means carried by each said arm.

* * * * *